US006889449B2

(12) United States Patent
Silver

(10) Patent No.: US 6,889,449 B2
(45) Date of Patent: May 10, 2005

(54) SANITIZING CABINET FOR SPORTS EQUIPMENT

(76) Inventor: Steve Silver, 1610 de Beauharnois St., Montreal, QC (CA), H4N 1J5

( * ) Notice: Subject to any disclaimer, the term of this patent is extended or adjusted under 35 U.S.C. 154(b) by 0 days.

(21) Appl. No.: 10/414,683

(22) Filed: Apr. 16, 2003

(65) Prior Publication Data

US 2004/0003511 A1 Jan. 8, 2004

Related U.S. Application Data

(63) Continuation-in-part of application No. 10/140,398, filed on May 7, 2002, now abandoned.

(51) Int. Cl.[7] ..... F26B 3/00

(52) U.S. Cl. ..... 34/490; 34/488; 34/489; 34/389

(58) Field of Search ..... 34/389, 423, 486, 34/487, 488, 489, 490

(56) References Cited

U.S. PATENT DOCUMENTS 4,922,624 A * 5/1990 Tharpe ..... 34/475
5,107,607 A * 4/1992 Mason ..... 34/191
5,195,251 A * 3/1993 Gyurcsek et al. ..... 34/489
5,369,892 A * 12/1994 Dhaemers ..... 34/275
6,134,806 A * 10/2000 Dhaemers ..... 34/404
6,458,398 B1 * 10/2002 Smith et al. ..... 426/320

* cited by examiner

*Primary Examiner*—Denise L. Esquivel
*Assistant Examiner*—Kathryn S. O'Malley
(74) *Attorney, Agent, or Firm*—Eric Fincham

(57) ABSTRACT

There is provided a method and apparatus for sanitizing sports equipment which comprises a cabinet which can be sealed, first and second conduits in fluid communication with the cabinet, an ozone generator, and fans for circulating ozone containing gas through the conduits into the cabinet, the fans being operative to circulate the ozone containing gas in a first direction and subsequently in a reverse direction. There is also provided a fluid storage device, the fluid storage device being associated with a spray action to spray the fluid into the cabinet after the ozone has been circulated.

7 Claims, 2 Drawing Sheets

SANITIZING CABINET FOR SPORTS EQUIPMENT

The present application is a continuation-in-part of application Ser. No. 10/140,398 filed May 7, 2002, now abandoned.

FIELD OF THE INVENTION

The present invention relates to an apparatus and a method for treating sports gear to sanitize the same.

BACKGROUND OF THE INVENTION

The problem of odors, mold, and mildew associated with sports equipment is common. Thus, while clothing and apparel can be washed and dried in a normal manner, much equipment cannot be subject to these processes. For example, in the sport of hockey, skates and protective pads and other paraphernalia cannot be put in commercial washers and dryers. Similarly, shoes and pads from other sports such as soccer and basketball cannot be washed and dried in a conventional manner.

It is known in the art, as shown in U.S. Pat. No. 5,369,893, that one may use self-contained dryers for accommodating sports equipment. The dryers have walls which cause heated air to recirculate in the drying chambers to decrease the moisture content of the air and increase the drying energy efficiency. Blowers and fans associated with electric heaters operate to circulate heated air through the drying chambers.

U.S. Pat. No. 5,369,892 discloses a chest or foot locker structure with a rigid housing wherein the top of the housing has a cover movable to an open position to allow access to the drying chamber. A motor driven fan located in an air mixing chamber within the housing draws air through a filter into the drying chamber. Air porous walls within the drying chamber allow air to mix the drying chamber back to the air mixing chamber for recirculation back into the drying chamber. Air also flows out of the drying chamber through a filter having activated charcoal to remove odors from the air discharged into the environment. This dryer utilizes an internal motor and fan associated with the electric heater and specialized porous walls within a housing.

U.S. Pat. No. 6,134,806 discloses a portable sports equipment bag having an air distributor which is connected with a hose to a blower and ozone generator operable to move air and ozone under pressure into the air distributor. The air distributor's one or more manifolds located within the bag, the manifolds having a plurality of apertures to allow air and ozone in the manifolds to flow into the bag to dry sports equipment and objects within the bag. There are air filters mounted on the bag to remove odors and foreign matters from the air flow from the bag into the environment.

U.S. Pat. No. 6,263,591 discloses a portable sports equipment drying container comprising a body having a cover with an input fan mounted in one of the side walls and an output fan mounted in another one of the walls. The fans are used for drying the moisture wet clothes and equipment placed in the container for circulating air through the container.

However, none of the prior art deals with the necessity of providing a completely sealed enclosure while using ozone for sanitization purposes. In this respect, there are regulations in most countries mandating that ozone cannot be created and vented to the atmosphere.

While the above patents do teach various apparati and methods for attempting to clean and sanitize sports equipment, there exists a need for an apparatus and method which can be used on a commercial basis for sanitizing sports equipment.

SUMMARY OF THE INVENTION

It is an object of the present invention to provide a method and apparatus which would sanitize sports equipment and which method and apparatus is suitable for use on a commercial basis and is environmentally friendly.

According to one aspect of the present invention, there is provided an apparatus for sanitizing sports equipment comprising, a cabinet having an access opening thereto, means for sealing the access opening to provide a substantially airtight cabinet, means for generating ozone and means for causing the ozone to circulate within the cabinet.

According to a further aspect of the present invention, there is provided a method of sanitizing sports equipment, the method comprising the steps of placing the sports equipment within a closed cabinet, circulating ozone containing air in a first direction through the cabinet for a first period of time, circulating the ozone containing air in a second direction opposite to the first direction through the cabinet for a second period of time, the ozone containing air having an ozone concentration of at least 20 ppm, stopping all circulation of the air and ozone for a period of time sufficient for the ozone concentration to diminish to less than 3 ppm, and removing the sports equipment from the cabinet.

Preferably, the cabinet is provided with means for securely sealing the same during the period of time when ozone containing air is within the cabinet. The tight sealing is required to prevent the escape of ozone and the possibility of environmental damage.

The walls of the cabinet can be formed of a transparent or opaque material resistant to ozone deterioration. Within the cabinet are means for accepting sports equipment, and in one embodiment, foraminous shelves may be provided. Naturally, hooks and other types of retainers may be utilized for any specialized equipment.

A preferred means of circulating the ozone containing air through the cabinet preferably comprises a pair of reversible fans located within the bottom wall of the cabinet defining the space for receiving the sports equipment. Such fans are known in the art and need not be described and detailed herein.

Preferably, the apparatus also includes means for spraying a fluid and preferably a liquid containing a product which will assist in depleting the ozone in the cabinet.

In operation, the sports equipment to be sanitized is placed within the cabinet and the access opening closed. Subsequently, ozone containing air is circulated in a first direction throughout the cabinet from the first one of said conduits and exits through a second one of said conduits. This is continued for a period of time which, in the preferred embodiment, would range between 5 and 15 minutes and more preferably, approximately 10 minutes.

Subsequently, the ozone containing air is circulated in a second direction from the second conduit and exiting through the first conduit. This is continued for a period of time which preferably is similar to those times in which it is circulated in a first direction.

Subsequently, an agent is lightly sprayed in a mist and the cabinet is maintained closed for a period of time sufficient for the ozone level to go down to at least 3 ppm and preferably below 2 ppm. The cabinet can then be opened and the sports equipment removed.

As aforementioned, preferably an ozone depleting agent is sprayed into the cabinet. While there are many compounds and compositions which are known to function as an ozone depleter, a particularly preferred embodiment utilizes a tea tree oil also know as a melaleuca oil. The advantage of such an oil is that it acts as a disinfectant.

In a preferred embodiment of the invention, the ozone depletion agent may be placed on a container and there may be provided means to ensure that the agent is dispersed a certain time prior to opening of the doors. Such control means are well known in the art and may include suitable timers and interlocks, as well as means to ensure that the ozone depleting agent is present in the container.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
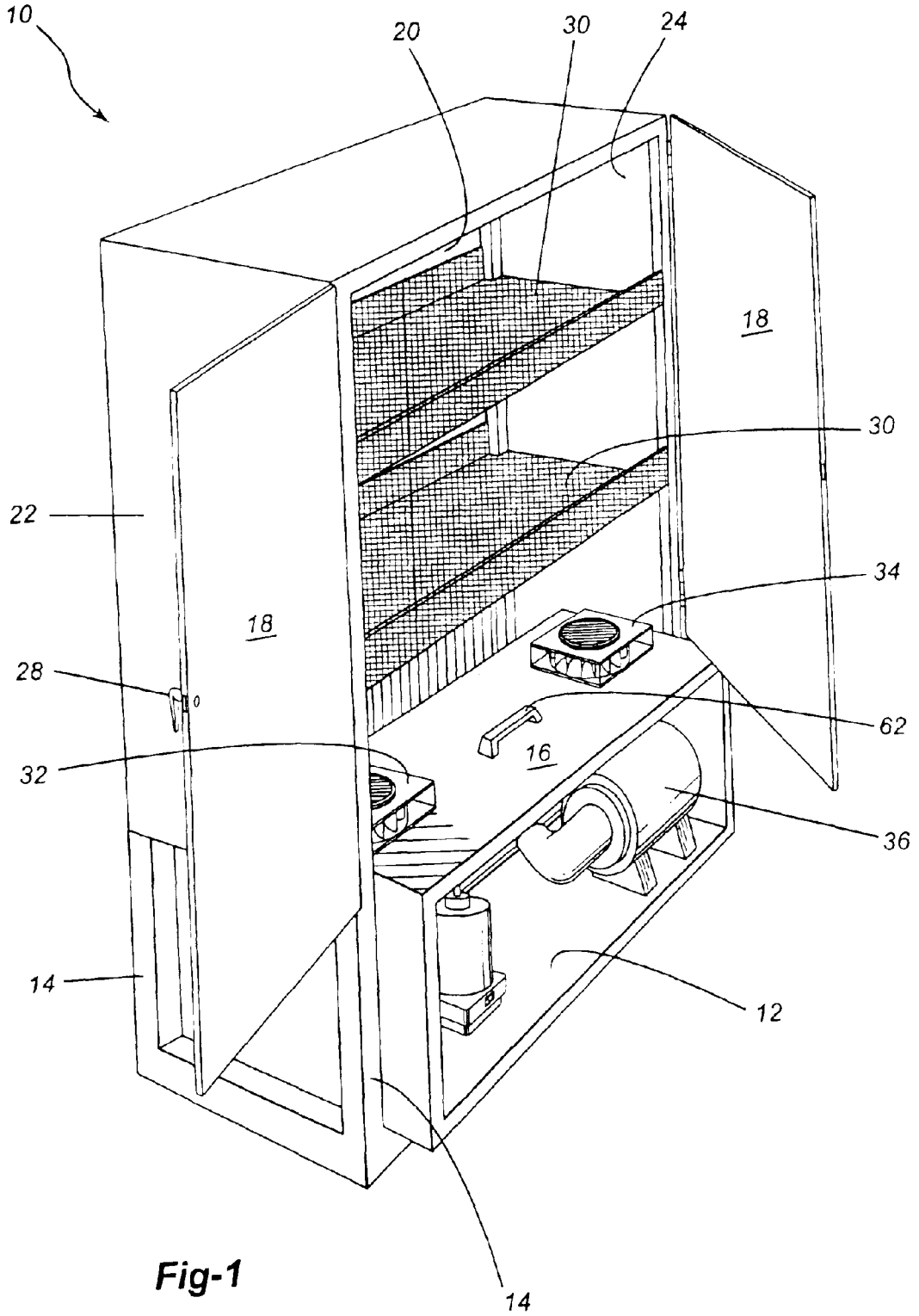
FIG. 1 is a perspective view of a sanitizing cabinet according to an embodiment of the present invention.
Figure 2:
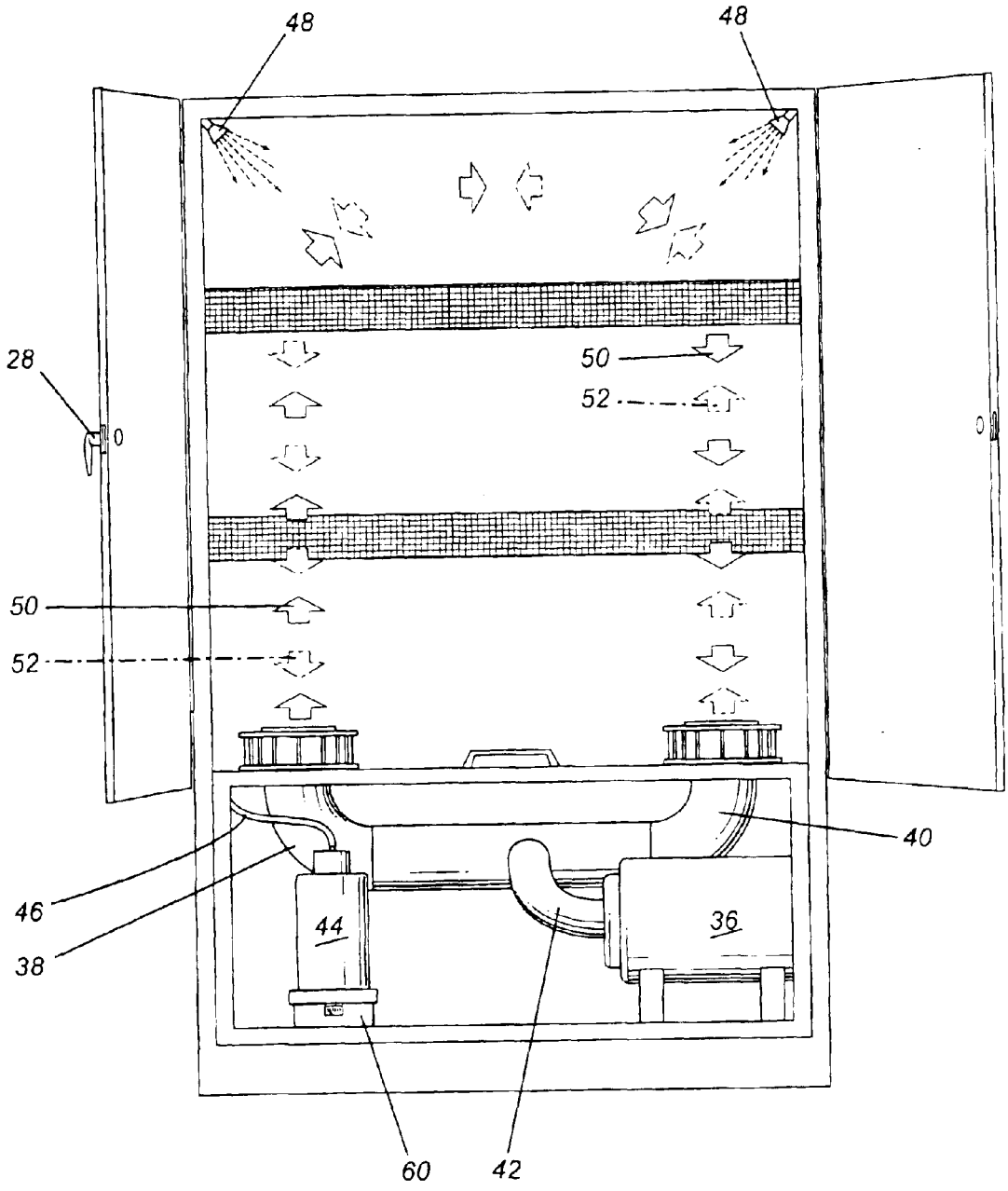
FIG. 2 is a front elevational view thereof illustrating use of the sterilizing cabinet.

As shown in FIGS. 1 and 2, there is provided a sterilizing cabinet which is generally designated by reference numeral 10. Sterilizing cabinet 10 includes a base member 12 and four structural uprights 14 extending upwardly therefrom.

A compartment is defined by a compartment floor 16, a front panel 18, a rear panel 20, and a pair of side panels 22, 24. As will be seen in FIG. 1, a pair of front panels 18 are hingedly connected. When closed, a locking handle 28 is designed to engage the other front panel 18 to maintain the compartment tightly sealed.

Placed within sanitizing cabinet 10 above floor 16 are a pair of foraminous shelves 30. Foraminous shelves 30 may be of various types of structures, either a mesh or using wires.

Mounted in floor 16 is a first fan assembly 32 which is adjacent side wall 22 and a second fan assembly 34 which is adjacent side panel 24.

Mounted in the lower portion of sanitizing cabinet 10 below floor 16 is an ozone generator 36.

A first conduit 38 is in fluid communication with first fan assembly 32 while a second conduit 40 is in fluid communication with second fan assembly 34. A connecting conduit 42 is connected to ozone generator 36 and is designed to supply both first conduit 38 and second conduit 40.

A reservoir 44 is provided to contain a supply of an ozone depleting agent having one or more additives therein. The water is connected via conduits 46 to spray heads 48 mounted in the upper portion of the sanitizing cabinet 10. A control panel (not shown) may contain conventional control circuitry including timers and interlocks. In this respect, there is provided a scale 60 which is designed to continually monitor the weight of reservoir 44 to ensure that the ozone depleting agent is present in a quantity sufficient to be sprayed within the cabinet. Naturally, other methods such as sensors within the reservoir 44 may be utilized. In all instances, lack of the presence of the ozone depleting agent would not permit operation of the apparatus.

In operation, and as shown by arrows 50, first fan assembly 32 is driven in a first direction to circulate the ozone containing air from first conduit 38 to a second conduit 40. Subsequently, the direction of circulation is reversed by reversing the directions of first and second fan assemblies 32 and 34 respectively. It will be noted that the ozone containing air circulates throughout the cabinet in order to assure that it contacts all the equipment placed therein.

The bottom may be removed as a unit by means of handle 62 to facilitate servicing.

It will be understood that the above described embodiment is for purposes of illustration only and that changes or modifications may be made thereto without departing from the spirit and scope of the invention.

I claim:

1. A method of sanitizing sports equipment, said method comprising the steps of:

placing said sports equipment within a closed cabinet;

circulating ozone containing air in a first direction through said cabinet for a first period of time;

circulating said ozone containing air in a second direction opposite to said first direction through said cabinet for a second period of time, said cabinet being sealed while said ozone containing air is circulated within said cabinet;

said ozone containing air having an ozone concentration of at least 20 ppm;

stopping all circulation of said air and ozone for a period of time sufficient for said ozone concentration to diminish to less than 3 ppm; and removing said sports equipment from said cabinet.

2. The method of claim 1 wherein said ozone containing air has an ozone concentration of at least 50 ppm.

3. The method of claim 1 further including the step of spraying a mist containing an ozone depleting material into said cabinet following the step of circulating said ozone containing air in a second direction.

4. The method of claim 3 wherein said ozone depleting agent is a tea tree oil.

5. The method of claim 2 wherein said first period of time comprises between 3 and 9 minutes.

6. The method of claim 1 wherein said second time is between 3 and 9 minutes.

7. The method of claim 4 wherein said period of time sufficient for said ozone concentration to diminish to less than 3 ppm comprises between 1 and 5 minutes.

* * * * *